US008685911B2

(12) United States Patent
Song

(10) Patent No.: US 8,685,911 B2
(45) Date of Patent: Apr. 1, 2014

(54) RINSE AID COMPOSITIONS

(75) Inventor: Xinbei Song, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 103 days.

(21) Appl. No.: 12/627,377

(22) Filed: Nov. 30, 2009

(65) Prior Publication Data

US 2011/0130322 A1 Jun. 2, 2011

(51) Int. Cl.
*C11D 3/37* (2006.01)

(52) U.S. Cl.
USPC ..... 510/220; 510/223; 510/227; 510/311; 510/514

(58) Field of Classification Search
USPC ..... 510/220, 223, 227, 311, 514
See application file for complete search history.

(56) References Cited

U.S. PATENT DOCUMENTS

| | | | | | |
|---|---|---|---|---|---|
| 3,308,067 | A | * | 3/1967 | Diehl | 510/346 |
| 3,880,765 | A | * | 4/1975 | Watson | 507/224 |
| 3,933,671 | A | | 1/1976 | Heile | |
| 3,983,079 | A | | 9/1976 | Spadini et al. | |
| 4,105,573 | A | | 8/1978 | Jacobsen | |
| 4,219,436 | A | | 8/1980 | Gromer et al. | |
| 4,223,163 | A | | 9/1980 | Guilloty | |
| 4,339,356 | A | | 7/1982 | Whyte | |
| 4,438,024 | A | | 3/1984 | DelGreco et al. | |
| 4,486,327 | A | | 12/1984 | Murphy et al. | |
| 4,515,705 | A | | 5/1985 | Moeddel | |
| 4,714,562 | A | | 12/1987 | Roselle et al. | |
| 4,740,327 | A | | 4/1988 | Julemont et al. | |
| 4,874,540 | A | * | 10/1989 | Greenwald et al. | 510/476 |
| 4,908,148 | A | | 3/1990 | Caravajal et al. | |
| 4,933,101 | A | | 6/1990 | Cilley et al. | |
| 4,966,724 | A | | 10/1990 | Culshaw et al. | |
| 5,061,393 | A | | 10/1991 | Linares et al. | |
| 5,066,419 | A | | 11/1991 | Walley et al. | |
| 5,154,842 | A | | 10/1992 | Walley et al. | |
| 5,232,613 | A | | 8/1993 | Bacon et al. | |
| 5,342,549 | A | | 8/1994 | Michael | |
| 5,478,502 | A | | 12/1995 | Swift | |
| 5,478,503 | A | | 12/1995 | Swift | |
| 5,500,154 | A | | 3/1996 | Bacon et al. | |
| 5,540,865 | A | | 7/1996 | Michael | |
| 5,670,475 | A | | 9/1997 | Trinh et al. | |
| 5,739,099 | A | * | 4/1998 | Welch et al. | 510/514 |
| 5,942,485 | A | | 8/1999 | Kemen | |
| 5,990,065 | A | * | 11/1999 | Vinson et al. | 510/237 |
| 6,093,764 | A | * | 7/2000 | Egraz et al. | 524/413 |
| 6,130,194 | A | | 10/2000 | Pancheri et al. | |
| 6,143,707 | A | * | 11/2000 | Trinh et al. | 510/220 |
| 6,152,152 | A | | 11/2000 | Reynen et al. | |
| 6,162,778 | A | | 12/2000 | McKillop et al. | |
| 6,191,083 | B1 | | 2/2001 | Brooks et al. | |
| 6,194,362 | B1 | | 2/2001 | Trinh et al. | |
| 6,218,345 | B1 | | 4/2001 | Brooks et al. | |
| 6,482,786 | B1 | | 11/2002 | Del Duca et al. | |
| 6,630,440 | B1 | | 10/2003 | Song et al. | |
| 7,160,849 | B2 | * | 1/2007 | Tsumori et al. | 510/476 |
| 7,241,726 | B2 | * | 7/2007 | Song et al. | 510/220 |
| 7,273,891 | B1 | * | 9/2007 | Bromberg et al. | 514/772.1 |
| 7,658,839 | B2 | | 2/2010 | Jensen | |
| 2004/0176264 | A1 | | 9/2004 | Song et al. | |
| 2005/0245427 | A1 | | 11/2005 | Baum et al. | |
| 2006/0293467 | A1 | | 12/2006 | Yoneda et al. | |
| 2007/0082831 | A1 | * | 4/2007 | Guzmann et al. | 510/220 |
| 2008/0188391 | A1 | | 8/2008 | Seebeck et al. | |

FOREIGN PATENT DOCUMENTS

| | | | |
|---|---|---|---|
| EP | 1578895 | B1 | 1/2008 |
| JP | 2004-067846 | A | 3/2004 |
| JP | 2004-307588 | A | 11/2004 |
| WO | WO 98/51771 | A1 | 11/1998 |
| WO | WO 02/081608 | A2 | 10/2002 |
| WO | WO 03/033638 | A1 | 4/2003 |
| WO | WO 2006/107060 | A1 | 10/2006 |
| WO | WO 2007/037469 | A1 | 4/2007 |

OTHER PUBLICATIONS

Int'l Search Report 5 Pages.

* cited by examiner

*Primary Examiner* — Nicole M Buie-Hatcher
*Assistant Examiner* — M. Reza Asdjodi
(74) *Attorney, Agent, or Firm* — Abbey A. Lopez

(57) ABSTRACT

A rinse aid composition comprising: a) a polymer comprising an acrylic acid backbone and alkoxylated side chains, said polymer comprising a molecular weight of from about 4,000 to about 22,000, the polymer comprising from about 20 wt % to about 50 wt % of an alkylene oxide; and b) a low foaming nonionic surfactant.

11 Claims, No Drawings

RINSE AID COMPOSITIONS

FIELD OF THE INVENTION

The present invention is directed to rinse aid compositions, for use in automatic dishwashers, containing a water soluble alkoxylated acrylic acid polymer.

BACKGROUND OF THE INVENTION

Traditional automatic dishwashing detergent formulations containing phosphate, and more particularly sodium tripolyphosphate (STPP), have proven to be effective for general cleansing of dishware as well as avoiding filming and spotting of dishware. Recent legislation requiring the removal of phosphate-based builders from automatic dishwashing detergents has created numerous formulation challenges. While some substitutes for STPP have demonstrated relatively effective cleaning, they tend to be less than optimal regarding spotting and/or filming.

In order to compensate for spotting and filming, formulators have supplemented phosphate-free compositions with sulfonated dispersant polymers and other additives which are designed to prevent redeposition of soils and precipitation in the wash water onto dishware. However, it has been found that not all substrates in the wash show the same results. For example, some formulations may prevent spotting on glass, but may have poor performance regarding filming on plastic. Accordingly, preventing filming and spotting on dishware in the absence of phosphorus-based cleaning products has proven to be difficult.

Based on the foregoing, there is a need for a rinse aid which provides acceptable filming and spotting on dishware in the absence of phosphorus-containing elements.

SUMMARY OF THE INVENTION

The present invention relates to a rinse aid composition comprising a polymer comprising an acrylic acid backbone and alkoxylated side chains, the polymer comprising a molecular weight of from about 4,000 to about 22,000, and the polymer comprising from about 20 wt % to about 50 wt % of an alkylene oxide; and a low foaming nonionic surfactant.

DETAILED DESCRIPTION OF THE INVENTION

While the specification concludes with claims that particularly point out and distinctly claim the invention, it is believed the present invention will be better understood from the following description.

All percentages, parts and ratios are based upon the total weight of the compositions, unless otherwise specified. All such weights as they pertain to listed ingredients are based on the active level and, therefore, do not include solvents or by-products that may be included in commercially available materials, unless otherwise specified. The term "weight percent" may be denoted as "wt %" herein.

All molecular weights as used herein are weight average molecular weights expressed as grams/mole, unless otherwise specified.

The term, "automatic dishwashing composition", means a composition which is introduced into an automatic dishwashing machine during its primary wash cycle for the purpose of cleaning dishware.

The term, "graft polymer" as used herein, means a polymer comprising molecules in which the main backbone chain of atoms has attached to it at various points side chains containing different atoms or groups from those in the main chain. The main chain may be a copolymer or may be derived from a single monomer.

The terms, "nil-phosphate", or "substantially free of a phosphate builder", as used herein, means that the automatic dish washing compositions comprise very low levels of phosphate, and preferably no phosphate. If phosphate is present in the compositions, it is preferred that the phosphate is not comprised as a builder.

The term, "rinse aid composition", means a composition which is introduced into an automatic dishwashing machine during its rinse cycle for purposes of anti-corrosion, anti-filming, anti-spotting, and the like.

Water Soluble Alkoxylated Acrylic Acid Polymer

The rinse aid composition comprises a water soluble alkoxylated acrylic acid polymer. The polymer should have a molecular weight of from about 4,000 to about 22,000, or from about 5,000 to about 15,000, or from about 6,000 to about 13,000. The alkylene oxide (AO) component of the polymer is generally propylene oxide (PO) or ethylene oxide (EO) and generally comprises from about 20 wt % to about 50 wt %, or from about 30 wt % to about 45 wt %, or from about 30 wt % to about 40 wt % of the polymer. The alkoxylated side chains of the water soluble polymers may comprise from about 10 to about 55 AO units, or from about 20 to about 50 AO units, or from about 25 to 50 AO units. The water soluble polymers may be configured as random, block, graft, or other known configurations. Methods for forming alkoxylated acrylic acid polymers are disclosed in U.S. Pat. No. 3,880,765. The water soluble polymer should comprise from about 1 wt % to about 30 wt % of the rinse aid composition. Alternately, the water soluble polymer comprises from about 5 wt % to about 25 wt %, or from about 10 wt % to about 20 wt % of the rinse aid composition.

The water soluble polymer herein provides anti-spotting and anti-filming benefits when incorporated into rinse aid compositions as a rinse aid additive. Without being limited by theory, the water soluble polymer has strong calcium ion binding ability, while having water hardness tolerance. As used herein, polymers with "water hardness tolerance" do not readily precipitate from water upon binding to calcium ions.

It is also believed that the water soluble polymers form a single layer on substrates, particularly on glass, by forming a calcium ion bridge between the water soluble polymer and substrate surface. It is also believed that the AO chains of the water soluble polymer extend from the substrate surface and prevent further deposition onto the substrate surface.

As the water soluble polymers provide particular benefits with respect to the rinse cycle, in one embodiment, the compositions are substantially free of a builder. In yet another embodiment, the compositions are nil-phosphate.

Acid

The compositions herein may additionally include an acid. Any suitable organic and/or inorganic acid in any suitable amount may be used in the rinse aid compositions and/or products. Some suitable acids include, but are not limited to acids selected from the group consisting of acetic acid, aspartic acid, benzoic acid, boric acid, bromic acid, citric acid, formic acid, gluconic acid, glutamic acid, lactic acid, malic acid, nitric acid, sulfamic acid, sulfuric acid, tartaric acid, and mixtures thereof.

In the case of a liquid rinse aid composition, adding an acid to the rinse aid composition enables water-soluble metal salts to at least partially dissolve in the composition. The acid also helps to at least partially reduce the precipitation on hard surfaces during the rinse cycle. The acid may also stabilize the liquid rinse aid composition against precipitation in the product prior to use.

In the case of a solid rinse aid composition, adding an acid to the rinse aid composition enables water-soluble metal salts, once released, to at least partially dissolve quickly in the wash and/or rinse liquor of an automatic dishwashing appliance so as to prevent insoluble material from forming and/or from depositing onto hard surfaces, such as on flatware, glasses, dishes and/or components inside the automatic dishwashing appliance itself.

pH

The rinse aid composition may be formulated within any suitable acidic pH range. The pH is measured at a 1% concentration in an aqueous solution for any form of the rinse aid composition.

Suitable pHs range from about 1 to less than about 6, alternatively from about 1 to about 5, and alternatively from about 1 to about 4. A lower pH range will tend to reduce incompatibility and negative interaction of the rinse aid composition with existing commercial rinse aid product residues left in the rinse aid dispenser reservoir of the automatic dishwashing appliance prior to use.

In one non-limiting embodiment, the pH of the rinse aid composition may be in the range of from about 1 to less than about 5.

Nonionic Surfactant

Any suitable non-ionic surfactant in any suitable amount may be used to make the rinse aid composition. Suitable non-ionic surfactants include, but are not limited to, low foaming nonionic surfactants (LFNIs). LFNIs are most typically used in automatic dishwashing compositions on account of the improved water-sheeting action (especially from glassware) which they confer to the rinse aide product. They also may encompass non-silicone, phosphate or nonphosphate polymeric materials further illustrated hereinafter which are known to defoam food soils encountered in automatic dishwashing.

In one non-limiting embodiment, an LFNI may include nonionic alkoxylated surfactants, especially ethoxylates derived from primary alcohols, and blends thereof with more sophisticated surfactants, such as the polyoxypropylene/polyoxyethylene/polyoxypropylene reverse block polymers. Suitable block polyoxyethylene-polyoxypropylene polymeric compounds that meet the requirements may include those based on ethylene glycol, propylene glycol, glycerol, trimethylolpropane and ethylenediamine, and mixtures thereof, as initiator reactive hydrogen compound. Polymeric compounds made from a sequential ethoxylation and propoxylation of initiator compounds with a single reactive hydrogen atom, such as $C_{12-18}$ aliphatic alcohols, do not generally provide satisfactory suds control in rinse aid compositions. However, certain of the block polymer surfactant compounds designated as PLURONIC® and TETRONIC® by the BASF-Wyandotte Corp., Wyandotte, Mich., are suitable in rinse aide compositions.

In another non-limiting embodiment, the LFNI may contain from about 40% to about 70% of a polyoxypropylene/polyoxyethylene/polyoxypropylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene initiated with trimethylolpropane and containing 99 moles of propylene oxide and 24 moles of ethylene oxide per mole of trimethylolpropane.

In another non-limiting embodiment, the rinse aid composition may include the use of ethoxylated monohydroxy alcohol or alkyl phenol and additionally comprise a polyoxyethylene, polyoxypropylene block polymeric compound; the ethoxylated monohydroxy alcohol or alkyl phenol fraction of the LFNI comprising from about 20% to about 80%, alternatively from about 30% to about 70%, of the total LFNI.

The LFNI can optionally contain propylene oxide in an amount up to about 15% by weight. Other alternative LFNI surfactants can be prepared by the processes described in U.S. Pat. No. 4,223,163, issued Sep. 16, 1980, Builloty.

The LFNI may be an ethoxylated surfactant derived from the reaction of a monohydroxy alcohol or alkylphenol containing from about 8 to about 20 carbon atoms, excluding cyclic carbon atoms, with from about 6 to about 15 moles of ethylene oxide per mole of alcohol or alkyl phenol on an average basis.

The LFNI may be derived from a straight chain fatty alcohol containing from about 16 to about 20 carbon atoms ($C_{16}$-$C_{20}$ alcohol), alternatively a $C_{18}$ alcohol, condensed with an average of from about 6 to about 15 moles, alternatively from about 7 to about 12 moles, and alternatively from about 7 to about 9 moles of ethylene oxide per mole of alcohol. Alternatively the ethoxylated nonionic surfactant so derived has a narrow ethoxylate distribution relative to the average.

Suitable for use as an LFNI in the rinse aid compositions are those LFNIs having relatively low cloud points and high hydrophilic-lipophilic balance (HLB). Cloud points of 1% solutions in water are typically below about 32° C. and alternatively lower, e.g., 0° C., for optimum control of sudsing throughout a full range of water temperatures.

An LFNI may, for example, be present in an amount in the range of from about 0.01% to about 60% by weight, alternatively from about 0.01% to about 50%, and alternatively from about 0.01% to about 40% by weight of the rinse aid composition.

In one non-limiting embodiment, the rinse aid composition comprises from about 0.01% to about 60% by weight of the composition of a low-foaming nonionic surfactant having a cloud point below 30° C. In another non-limiting embodiment, the surfactant may be a low cloud point nonionic surfactant selected from the group consisting of $C_{9/11}EO_8$-cyclohexyl acetal alkyl capped nonionic, $C_{11}EO_7$-n-butyl acetal, $C_{9/11}EO_8$-2-ethylhexyl acetal, $C_{11}EO_8$-pyranyl, alcohol alkoxylate, and mixtures thereof.

In another non-limiting embodiment, the LFNI may include a $C_{1-8}$ alcohol polyethoxylate, having a degree of ethoxylation of about 8, commercially available SLF18® from Olin Corp™. Any biodegradable LFNI having the melting point properties discussed herein above, and mixtures thereof.

Particulate Zinc-Containing Materials (PZCMs)

The compositions may also comprise particulate zinc-containing materials (PZCMs). PZCMs remain mostly insoluble within formulated compositions. Examples of PZCMs useful in certain non-limiting embodiments may include the following:

Inorganic Materials: zinc aluminate, zinc carbonate, zinc oxide and materials containing zinc oxide (i.e., calamine), zinc phosphates (i.e., orthophosphate and pyrophosphate), zinc selenide, zinc sulfide, zinc silicates (i.e., ortho- and meta-zinc silicates), zinc silicofluoride, zinc borate, zinc hydroxide and hydroxy sulfate, zinc-containing layered materials, and mixtures thereof.

Natural Zinc-containing Materials/Ores and Minerals: sphalerite (zinc blende), wurtzite, smithsonite, franklinite, zincite, willemite, troostite, hemimorphite, and mixtures thereof.

Organic Salts: zinc fatty acid salts (i.e., caproate, laurate, oleate, stearate, etc.), zinc salts of alkyl sulfonic acids, zinc naphthenate, zinc tartrate, zinc tannate, zinc phytate, zinc monoglycerolate, zinc allantoinate, zinc urate, zinc amino acid salts (i.e., methionate, phenylalinate, tryptophanate, cysteinate, etc), and mixtures thereof.

Polymeric Salts: zinc polycarboxylates (i.e., polyacrylate), zinc polysulfate, and mixtures thereof.

Physically Adsorbed Forms: zinc-loaded ion exchange resins, zinc adsorbed on particle surfaces, composite particles in which zinc salts are incorporated (i.e., as core/shell or aggregate morphologies), and mixtures thereof.

Zinc Salts: zinc oxalate, zinc tannate, zinc tartrate, zinc citrate, zinc oxide, zinc carbonate, zinc hydroxide, zinc oleate, zinc phosphate, zinc silicate, zinc stearate, zinc sulfide, zinc undecylate, and the like, and mixtures thereof.

Commercially available sources of zinc oxide include Z-Cote and Z-Cote HPI (BASF), and USP I and USP II (Zinc Corporation of America).

PZCMs provide many benefits in rinse aid compositions. Delivery of these benefits generally requires that the $Zn^{2+}$ ion be chemically available without being soluble. This is termed "zinc lability". Certain physical properties of the PZCM have the potential to impact zinc lability. In one embodiment, PZCMs provide at least some glassware surface corrosion protection to glassware surfaces. This, and other specific benefits associated with PZCMs are described in U.S. Pat. No. 7,241,726.

Perfume

Any suitable perfume in any suitable amount may be used to make the rinse aid composition. Perfumes are useful for improved odor profiles of the rinse aid composition, as well as, during the automatic dishwashing operation.

A perfume may, for example, be present in an amount from about 0.01% to about 5%, alternatively from about 0.1% to about 3%, and alternatively from about 0.1% to about 2% of a perfume composition. Suitable perfumes used in this rinse aid composition may be classified as non-blooming as well as blooming perfumes.

The following references disclose a wide variety of perfumes U.S. Pat. No. 3,983,079; U.S. Pat. No. 4,105,573; U.S. Pat. No. 4,219,436; U.S. Pat. No. 4,339,356; U.S. Pat. No. 4,515,705; U.S. Pat. No. 4,714,562; U.S. Pat. No. 4,740,327; U.S. Pat. No. 4,933,101; U.S. Pat. No. 5,061,393; U.S. Pat. No. 5,066,419; U.S. Pat. No. 5,154,842; U.S. Pat. No. 5,232,613; U.S. Pat. No. 5,500,154; U.S. Pat. No. 5,670,475; U.S. Pat. No. 6,143,707; and U.S. Pat. No. 6,194,362.

Hydrotrope

Any suitable hydrotrope in any suitable amount may be used to make the rinse aid composition. Suitable hydrotropes include, but are not limited to, sodium benzene sulfonate, sodium toluene sulfonate, sodium cumene sulfonate, and mixtures thereof.

The following references disclose a wide variety of suitable hydrotropes: U.S. Pat. No. 6,130,194; U.S. Pat. No. 5,942,485; U.S. Pat. No. 5,478,503; U.S. Pat. No. 5,478,502; U.S. Pat. No. 6,482,786; U.S. Pat. No. 6,218,345; U.S. Pat. No. 6,191,083; U.S. Pat. No. 6,162,778; U.S. Pat. No. 6,152,152; U.S. Pat. No. 5,540,865; U.S. Pat. No. 5,342,549; U.S. Pat. No. 4,966,724; U.S. Pat. No. 4,438,024; and U.S. Pat. No. 3,933,671.

Binder

Embodiments comprising solid rinse aid compositions may also contain any suitable binder in any suitable amount. The binding agent of the solid rinse aid composition holds the dry components together in a single mass. The binding agent may comprise any material which is relatively high melting and which will maintain product integrity.

Suitable binders include, but are not limited to, materials such as nonionic surfactants, polyethylene glycols, anionic surfactants, film forming polymers, fatty acids, and mixtures thereof, wherein the binder does not melt below 40° C., as disclosed in U.S. Pat. No. 4,486,327, Murphy et al, issued Dec. 4, 1984. In certain embodiments, certain binders include alkali metal phosphates, fatty amides, and combinations thereof.

Suitable binders, for example, may be optionally incorporated in the rinse aid composition at a level of from about 0.05% to about 98%, alternatively from about 0.05% to 70%, alternatively from about 0.05% to 50%, alternatively from about 0.05% to 30%, alternatively from about 0.05% to 10%, and alternatively from 0.1% to 5% by weight of the total composition. Filler materials can also be present in the rinse aid composition. These may include sucrose, sucrose esters, alkali metal chlorides or sulfates, in amounts from 0.001% to 60%, and alternatively from 5% to 30% of the composition.

Carrier Medium

Any suitable carrier medium in any suitable amount may be used to make the rinse aid composition. Suitable carrier mediums include both liquids and solids. Several non-limiting examples of types of carrier mediums are provided by way of explanation, and not by way of limitation. In one example, the rinse aid composition can be provided in the form of an aqueous or non-aqueous liquid in a container. In another example, the rinse aid composition may exist in a solid form in a container and the solid could be dissolved with water. In another example, the rinse aid composition can be provided in the form of a combination of both a liquid and a solid that can be diluted or dissolved with water. In one non-limiting embodiment, the form of the rinse aid composition can be a dry powder, granule or tablet, encapsulated product, and combinations thereof.

One suitable carrier medium may be water, which can be distilled, deionized, or tap water. Water may be preferred due to its low cost, availability, safety, and compatibility. In other non-limiting embodiments the carrier medium may be tap water.

In one non-limiting embodiment in which the carrier medium may be aqueous, at least some of the aqueous carrier may be purified beyond the treatment it received to convert it to tap water (that is, the tap water may be post-treated, e.g., deionized or distilled). In yet another non-limiting embodiment at least some of the carrier may be hard water having a hardness of at least 3.3 mM (Calcium:Magnesium=3:1).

Optionally, in addition to water, the carrier can contain a low molecular weight organic solvent that may be highly soluble in water, e.g., ethanol, methanol, propanol, isopropanol and the like, and mixtures thereof. Low molecular weight alcohols can allow the treated dish- and glassware surface to dry faster. The optional water-soluble low molecular weight solvent can also be used at a level of up to about 50%, typically from about 0.1% to about 25%, alternatively from about 2% to about 15%, alternatively from about 5% to about 10%, by weight of the suitable carrier medium.

Factors that need to be considered when a high level of solvent is combined with the suitable carrier medium are odor, flammability, dispersancy and environment impact.

Rinse aid compositions can also be in a "concentrated form", in such case, the concentrated liquid rinse aid composition according one non-limiting embodiment will contain a lower amount of a suitable carrier medium, compared to conventional liquid rinse aid compositions. For example, the suitable carrier medium content of the concentrated system may, for example, be present in an amount from about 30% to about 99.99% by weight of the rinse aid composition. The dispersant content of the concentrated system rinse aid composition may, for example, be present in an amount from about 0.001% to about 10% by weight of the rinse aid composition.

Product Form

The rinse aid composition may be used in any variety of product forms, including, but not limited to, liquid, gel, solid, granular, powder, and combinations thereof. In one non-limiting embodiment, the rinse aid composition may be formulated as a solid to deliver a water-soluble metal salt to the rinse without excessive precipitation. In another non-limiting embodiment, the rinse aid composition comprising water-soluble metal salt in the form of a solid, which may delay release of the composition until the rinse cycle.

The rinse aid composition in any physical form (e.g. liquid, gel, solid, granular, powder, and combinations thereof) may be packaged in a water-soluble or water dispersible pouch, and combinations thereof, to deliver the composition to the rinse liquor. The rinse aid composition can be in the form of a unit dose, which allows for the controlled release (for example delayed, sustained, triggered or slow release) of the composition during the rinse cycle of an automatic dishwashing appliance.

Single- and multi-compartment water-soluble pouches may be suitable for use. In the case of additive and multi-component products, the rinse aid compositions do not need to be in the same physical form. In another non-limiting embodiment, the rinse aid composition may be formulated in a multi-compartmental pouch so that negative interactions with other rinse aid components are minimized.

In yet another embodiment, rinse aid compositions suitable for use can be dispensed from any suitable device, such as bottles (pump assisted bottles, squeeze bottles), paste dispensers, capsules, multi-compartment bottles, multi-compartment capsules, and single- and multi-compartment water-soluble pouches, and combinations thereof.

In another non-limiting embodiment, the rinse aid composition can be in the form of a unit dose which allows for the controlled release (for example delayed, sustained, triggered or slow release) of the composition during the rinse cycle of an automatic dishwashing appliance. In unit dose forms, for example, the rinse aid composition may be a solid, granular, powder, liquid, gel, and combinations thereof, and may be provided as a tablet or contained in a single or multi-compartment water-soluble pouch.

Method of Use

In one non-limiting embodiment, a method of rinsing cleaned glassware may comprise rinsing the cleaned glassware in an automatic dishwashing machine with a rinse aid composition comprising: (a) the water soluble alkoxylated acrylic acid polymer described herein; (b) a non-ionic surfactant; (c) optionally an acid; and (d) optionally at least one component selected from the group consisting of dispersant polymer, perfume, hydrotrope, binder, carrier medium, antibacterial active, dye, zinc carbonate, zinc chloride, and mixtures thereof. The rinse aid composition should have a pH of less than about 6 when measured at a 1% concentration in an aqueous solution.

In another non-limiting embodiment, a use of the water soluble polymer herein for coating glassware is disclosed. According to such use, the water soluble polymer may be applied to glassware in an aqueous solution alone, or as one component of a rinse aid composition comprising other suitable ingredients. Further, the water soluble polymer may be used for coating glassware as an ingredient in automatic dishwashing compositions, or as an ingredient in hard surface cleaning compositions.

Kit

In one non-limiting embodiment, a kit may comprise (a) a package, (b) instructions for use, and (c) a rinse aid composition suitable for use in automatic dishwashing comprising (i) the water soluble alkoxylated acrylic acid polymer described herein; (ii) a non-ionic surfactant; (iii) optionally an acid; (iv) and optionally at least one of the following: a dispersant polymer, perfume, hydrotrope, binder, carrier medium, antibacterial active, dye, and mixtures thereof. The rinse aid composition may be a liquid, gel, solid, granular, powder, and combinations thereof, and may be provided as a tablet or contained in a single or multi-compartment water-soluble pouch.

Test Methods

Weight-Average Molecular Weight

The weight-average molecular weight (Mw) refers to the value measured by means of GPC (gel permeation chromatography).

Measurement device: "Shodex SYSTEM-2" manufactured by Showa Denko K.K.

Column: It is prepared by connecting in series the "Asahipak GF-710 HQ" and "Ashipak GF-310 HQ" manufactured by Showa Denko K.K.

Eluting liquid: 0.1N sodium acetate/acetonitrile=7/3 (ratio by volume)

Flow rate: 0.5 mL/min

Temperature: 40° C.

Calibration line: It is prepared by using a standard sample of polyacrylic acid (product of Sowa Kagaku K.K.)

Detector: RI

Non-Limiting Examples

The compositions illustrated in the following Examples illustrate specific embodiments of the compositions of the present invention, but are not intended to be limiting thereof. Other modifications can be undertaken by the skilled artisan without departing from the spirit and scope of this invention. These exemplified embodiments of the composition of the present invention provide good anti-filming of hard surfaces.

The compositions illustrated in the following Examples are prepared by conventional formulation and mixing methods, an example of which is set forth herein below. All exemplified amounts are listed as weight percents and exclude minor materials such as diluents, preservatives, color solutions, imagery ingredients, botanicals, and so forth, unless otherwise specified.

| Ingredient | Examples 1 | 2 | 3 | 4 | 5 | 6 | 7 |
|---|---|---|---|---|---|---|---|
| Nonionic Surfactant (1) | 25 | 30 | 15 | 10 | 30 | 20 | 20 |
| Citric Acid | 6 | — | 2 | 2 | 6 | 6 | 4 |
| Polyacryalte copolymer (20% neutralized) (2) | 3 | 4 | — | — | 7 | 5 | 2 |
| Hydrotrope (3) | 7 | 12 | 5 | 10 | 5 | — | 4 |
| Ethanol | 6 | 5 | 7 | 3 | 3 | 5 | 5 |
| Perfume | — | 0.25 | — | 0.12 | — | — | 0.15 |
| Zinc Oxide | — | — | — | 0.5 | — | — | 0.5 |
| Nitric acid | 0.1 | 0.2 | 0.1 | 0.1 | — | 0.1 | 0.2 |
| ZnCl2 | — | — | — | 0.8 | 0.5 | — | 0.8 |
| Water Soluble Polymer (4) | 10 | — | — | — | — | — | — |
| Water Soluble Polymer (5) | — | 15 | — | — | — | — | — |
| Water Soluble Polymer (6) | — | — | 20 | — | — | — | — |
| Water Soluble Polymer (7) | — | — | — | 30 | — | — | — |
| Water Soluble Polymer (8) | — | — | — | — | 5 | | — |
| Water Soluble Polymer (9) | — | — | — | — | — | 1 | — |
| Water Soluble Polymer (10) | — | — | — | — | — | — | 5 |
| Water and Minors (q.s. to 100%) | q.s. | q.s. | q.s. | q.s. | q.s. | q.s. | |

(1) Plurafac RA-30 available from BASF (2) Acusol 480 N ™ available from Rohm & Haas (3) Naxonate 45SC available from Nease Performance Chemicals (4) Acrylic acid/ethylene oxide graft copolymer having 50 EO units, MW 6,000, and ratio of acrylic acid to ethylene oxide ~80:20

(5) Acrylic acid/ethylene oxide graft copolymer having 50 EO units, MW 9,000, and ratio of acrylic acid to ethylene oxide ~60:40

(6) Acrylic acid/ethylene oxide graft copolymer having 50 EO units, MW 13,000, and ratio of acrylic acid to ethylene oxide ~60:40

(7) Acrylic acid/ethylene oxide graft copolymer having 10 EO units, MW 7,000, and ratio of acrylic acid to ethylene oxide ~65:35

(8) Acrylic acid/ethylene oxide graft copolymer having 25 EO units, MW 5,000, and ratio of acrylic acid to ethylene oxide ~65:35

(9) Acrylic acid/ethylene oxide graft copolymer having 50 EO units, MW 5,500, and ratio of acrylic acid to ethylene oxide ~70:30

(10) Acrylic acid/ethylene oxide graft copolymer having 25 EO units, MW 8,000, and ratio of acrylic acid to ethylene oxide ~60:40

Unless otherwise noted, all component or composition levels are in reference to the active level of that component or composition, and are exclusive of impurities, for example, residual solvents or by-products, which may be present in commercially available sources.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention.

While particular embodiments have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An aqueous liquid rinse aid composition for use in automatic dishwashing comprising:

a) from about 1% to about 20% of a graft copolymer by weight of the composition, wherein the graft copolymer consists of an acrylic acid backbone having ethylene oxide side chains, wherein the ethylene oxide side chains comprise from 10 to 55 ethylene oxide units, and wherein the ethylene oxide side chains comprise from 20 wt % to 45 wt % of the graft copolymer, respectively; and wherein the graft copolymer comprises a molecular weight of from about 5,000 to about 13,000;

b) from about 10% to about 60% of a low foaming nonionic surfactant by weight of the composition;

c) water; and d) from about 2% to about 25% by weight of the composition of a low molecular weight organic solvent selected from the group consisting of ethanol, methanol, propanol, isopropanol, and mixtures thereof;

wherein said composition has a pH from about 1 to about 6.

2. An aqueous liquid rinse aid composition according to claim 1, wherein said composition has a pH of from about 1 to about 4.

3. An aqueous liquid rinse aid composition according to claim 1, further comprising an acid.

4. An aqueous liquid rinse aid composition according to claim 3, wherein said acid is selected from the group consisting of nitric acid, acetic acid, formic acid, gluconic acid, glutamic acid, malic acid, nitric acid, sulfuric acid, and mixtures thereof.

5. An aqueous liquid rinse aid composition according to claim 1, further comprising a particulate zinc-containing material.

6. An aqueous liquid rinse aid composition according to claim 5, wherein said particulate zinc-containing material is selected from the group consisting of zinc aluminate, zinc carbonate, zinc oxide and mixtures thereof.

7. An aqueous liquid rinse aid composition according to claim 1, further comprising from about 1% to about 10% by weight of the composition of a hydrotrope, wherein the hydrotrope is selected from the group consisting of sodium benzene sulfonate, sodium toluene sulfonate, sodium cumene sulfonate, and mixtures thereof.

8. An aqueous liquid rinse aid composition according to claim 1, further comprising from about 0.05% to about 30% by weight of the composition of a binder.

9. A kit comprising:

a) a package, b) instructions for use, and c) an aqueous liquid rinse aid composition according to claim 1.

10. An aqueous liquid rinse aid composition according to claim 1, wherein said graft copolymer is capable of bonding with a calcium ion.

11. An aqueous liquid rinse aid composition according to claim 1, wherein the ethylene oxide side chains comprise from about 30 wt % to about 40 wt % of the graft copolymer.

* * * * *